United States Patent [19]

VanDril

[11] 4,000,885

[45] Jan. 4, 1977

[54] CUPOLA FURNACE WASTE GAS RECUPERATIVE SYSTEM AND METHOD FOR OPERATING SAME

[75] Inventor: William A. VanDril, Chicago Heights, Ill.

[73] Assignee: Whiting Corporation, Harvey, Ill.

[22] Filed: Nov. 18, 1974

[21] Appl. No.: 524,543

[52] U.S. Cl. ..... 266/83; 266/155; 266/159; 266/219; 55/226

[51] Int. Cl.[2] ..... C21B 7/22

[58] Field of Search ..... 55/89, 226, 338; 75/60, 75/43; 266/15, 16, 17, 24, 25, 83, 155, 159, 219

[56] References Cited

UNITED STATES PATENTS

| | | | |
|---|---|---|---|
| 970,654 | 9/1910 | Sepulchre | 55/89 |
| 2,788,087 | 4/1957 | Lenehan | 55/338 |
| 2,995,354 | 8/1961 | Tunder et al. | 266/25 X |
| 2,997,288 | 8/1961 | Schwechheimer et al. | 266/83 |
| 3,177,065 | 4/1965 | Okaniwa et al. | 75/60 |
| 3,389,897 | 6/1968 | Tunder et al. | 266/17 |
| 3,479,021 | 11/1969 | Escher | 266/17 X |
| 3,695,004 | 10/1972 | DeLisio et al. | 55/338 |
| 3,726,065 | 4/1973 | Hausberg et al. | 55/226 |
| 3,727,587 | 4/1973 | Nebgen | 266/155 |

OTHER PUBLICATIONS

*The Cupola and Its Operation*, American Foundrymans Society, Third Edition, 1965, pp. 29–31, 85.

*Primary Examiner*—Roy Lake
*Assistant Examiner*—Paul A. Bell
*Attorney, Agent, or Firm*—Lockwood, Dewey, Zickert & Alex

[57] ABSTRACT

An improved cupola furnace waste gas recuperative system and method for collecting waste furnace gases, cleaning them for the purpose of safely burning same either in a recuperator-heat exchanger for preheating incoming furnace blast air or for other heating purposes. The improvement consists of a method and means to control the pressure inside of the gas take-off chamber of an open, top charged, cupola furnace for the purposes of preventing gases from escaping through the charging hopper, preventing the indraft of excessive amounts of air, preventing explosive combustion and flashback of the waste gas and maintaining cleaning efficiency at any gas flow rate. Means include the controlled recirculation of a variable portion of the waste gas through part of the gas cleaning system and control of the furnace top gas pressure as a function of the incoming cupola furnace blast air.

6 Claims, 7 Drawing Figures

CUPOLA FURNACE WASTE GAS RECUPERATIVE SYSTEM AND METHOD FOR OPERATING SAME

This invention relates to a cupola furnace waste gas recuperative system and method for operating same, and more particularly to means and method for controlling gas pressure at the top of the furnace by recirculation of a portion of the waste furnace gases through a portion of a gas cleaning system.

In order to protect the environment from harmful industrial air pollution, methods and apparatus have been proposed for conditioning waste gases which are a by-product of iron-making furnace operations. Capturing such effluent waste gases is especially difficult in a cupola furnace because, as opposed to present blast furnace operations, the top of a top-charging cupola furnace is opened to the atmosphere.

Presently reported cupola waste gas recuperative apparatus generally are divided into two categories. One category of apparatus mixes atmospheric air with the hot waste gases emitted from the furnace causing their combustion. The hot products of combustion together with particulate pollutants are next passed over heat exchange surfaces for heating cold incoming furnace blast air on the opposite side of those surfaces which is introduced into the furnace through a blast air main, bustle pipe, and tuyeres. The waste gases are then cleaned by any method of scrubbing or filtering to remove the particulates and pollutants before releasing same to the atmosphere. Waste combustion gases are moved through the recuperative system by an exhaust blower or fan means, preferably located in a portion of the system through which the cleaned gas flows.

A second category of apparatus known as a latent heat type recuperator, captures cupola furnace waste gas in a "below the charge door gas take-off", then conditions, cools, and scrubs the gases to remove pollutants and particulate matter. Cleaned gases are subsequently introduced into a combustion chamber by means of a blower or compressor, where they are mixed with air and burned. The resulting hot products of combustion are passed through a heat exchanger for heating cold incoming cupola furnace blast air and then released to the atmosphere. Cleaned cupola furnace gases, not required for heating of blast air, may be used for other purposes such as firing in a waste heat boiler.

One of the advantages of this apparatus is the heat exchange surfaces require little or no cleaning as particulate contaminants are removed from the waste gases prior to burning them. This invention relates to the second category of apparatus hereinafter called a clean gas recuperator. Present clean gas recuperators have several shortcomings.

A problem exists with known clean gas recuperative apparatus which utilizes a closing valve between the cupola furnace and the gas cleaning apparatus and recuperator for the purpose of controlling the gas take-off chamber pressure because additional systems are required to maintain cleaning efficiency at any flow rate. In this connection, problems exist with known apparatus used for cleaning the waste gases, commonly a wet orifice scrubber. A wet orifice scrubber separates particles from gases by wetting the particles, accelerating the mixture through a venturi orifice, and then diverting the gas from the path of the particles in the discharge section of the scrubber. The efficiency of a wet orifice scrubber depends upon the pressure differential through the orifice. In heretofore known waste gas recuperative apparatus, it is customary to make the orifice of the scrubber variable in order to maintain a minimum required pressure differential across that orifice for maintaining cleaning efficiency at reduced flow rates. This requires a separate pressure differential control with its associated additional maintenance and wear problems.

Also, a variable speed exhaust blower and its associated control devices are necessary if a closing valve is utilized in the recuperator.

Another problem exists in preventing the exhauster or blower from surging when the flow rate of the scrubber is less than 50 percent of the design flow.

An additional problem in the existisng apparatus is that no workable system other than a manual control is provided to govern the amount of in-draft air brought in through the open top of the cupola during its operation relative to the amount of waste gases generated. For safe operation of a clean gas recuperative system, the amount of indraft air at the top of the cupola furnace should be closely controlled at all times. If excessive air is drawn in and mixed with the waste gas, its oxygen content can cause accidental explosive combustion of the waste gases resulting in danger to life and property.

Applicant's invention solves the above problems associated with prior recuperative apparatus by removing the direct valve means connection between the furnace and recuperative system and adding means for recirculating waste gases in a controlled manner through the portion of the system which removes the pollutant particles. Controllably recirculating the clean waste gases aids in determining the waste gas pressure at the top of the furnace, and maintaining the efficiency of particulate matter removal from the waste furnace gases by maintaining full flow through a constant orifice venturi scrubber. Full flow through the venturi gas cleaning portion of the system eliminates any surging in the fan or blower.

Applicant's invention also includes a control system not heretofore known or utilized which safely integrates the operation of the furnace with the operations of the gas cleaner and the recuperator for any furnace gas flow rate.

It is therefore an object of the invention to provide a new and improved method and system for cupola furnace waste gas recuperation.

An important object of the invention is to provide an apparatus for controllably recirclating waste furnace gases through at least a portion of the waste gas recuperative system.

Another object of the invention is the provision of a waste gas recuperative system which integrally functions with the cupola furnace because barrier means therebetween is eliminated and which is capable of controlling the amount of indraft air in proportion to the amount of gases generated to provide safe and explosion free operations at any flow rate up to full design flow.

A still further object of the invention is to provide a control apparatus for the entire system including control means in the recirculation means for determining gas pressure at the top of the furnace, while maintaining the efficiency of the gas cleaning apparatus without the need for a variable orifice scrubber.

Other objects, features, and advantages of the invention will be apparent from the following detailed disclosure, taken in conjunction with the accompanying sheets of drawings, wherein like reference numerals refer to like parts, in which.

Figure 1:
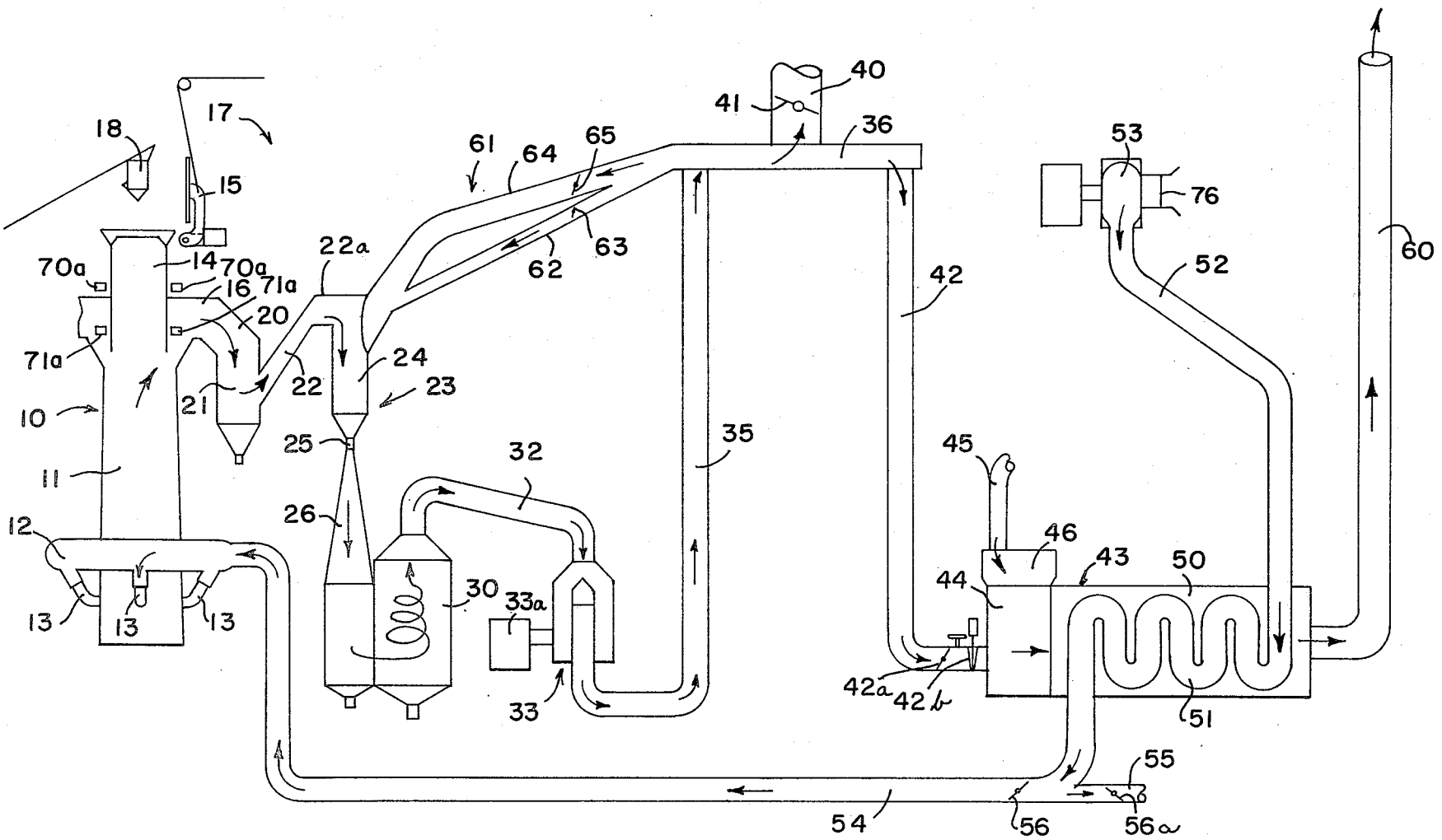
FIG. 1 is a diagram of a cupola furnace and a waste gas recuperative system forming one embodiment of the invention operatively connected thereto.
Figure 2:
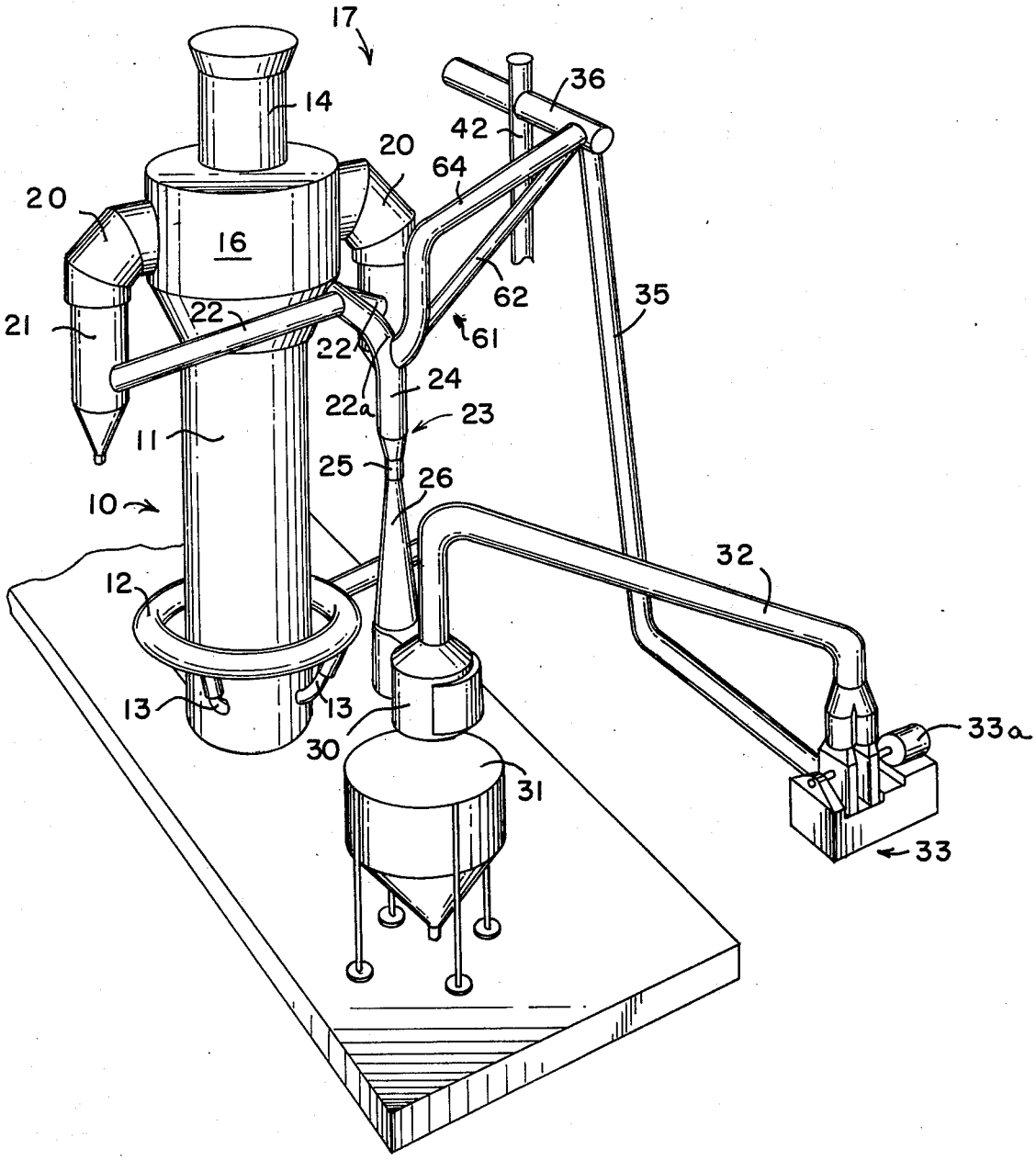
FIG. 2 is a perspective view of a cupola and of the portion of the recuperative system through which recirculation takes place.
Figure 3:
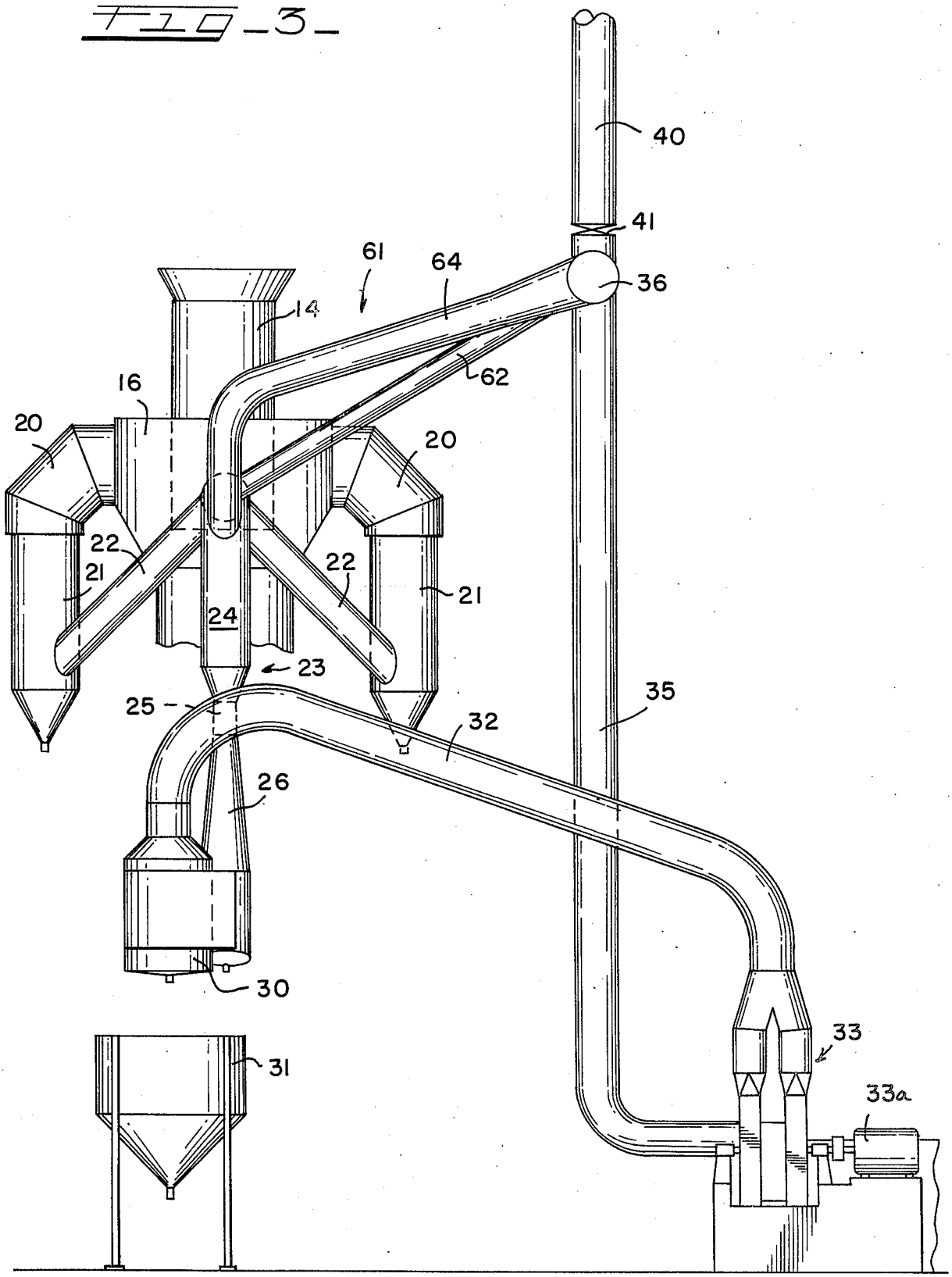
FIG. 3 is a vertical elevational view of the portion of the waste gas recuperative system through which recirculation of the waste gases takes place.

Referring to FIGS. 1 and 2, a conventional cupola furnace is indicated generally at 10. It includes a stack 11 within which the charge (not shown) is located. A bustle pipe 12 surrounds the bottom portion of the stack 11, and a plurality of tuyeres 13 connect the bustle pipe 12 with that bottom portion and provides a passageway for blast air which is blown into the cupola 10. At the top of the cupola is a cylindrical charge hopper 14 and a top cover 15 which is movable to open or close the top of the furnace. Between the charge hopper 14 and the stack 11 is an annular gas takeoff chamber 16 which surrounds the lower part of the charge hopper below the charge level maintained therein, and forms the coupling between the cupola 10 and the waste gas cleaning system, shown generally at 17. Take-off chamber 16 is refractory-lined and has ducts 20 extending diametrically from opposite sides thereof.

Hot waste furnace gases exit the stack 11 and travel at low velocity through the take-off chamber 16, ducts 20, and into quenchers 21 of known type. Quenchers 21 are vertically oriented chambers each having water spray nozzles (not shown) facing inwardly of the quencher which emit water sprays into the dirty gases passing therethrough. Within the quenchers hot gases are cooled to approximately saturation temperature and water vapor is added to the gases to very nearly saturation. Heavy dust particles and excess-water collect on the conical bottom of the quenchers and are washed away through the drain connection to a disposal tank. The downward traveling gases are then deflected upwardly through gas ducts 22.

Each gas duct 22 joins at its upper end to a duct 22a which leads into a venturi gas scrubber, shown generally at 23. Prior art waste gas recuperators have a positively closing valve means located in the ducting means between the quenchers 21 and the scrubber entrance 24 in the common duct 22a which controls the waste gas flow through the recuperator. Applicant's improvements allow the cupola and recuperator system to be interconnected without such valve means since gas flow is controlled by recirculation means discussed below. The venturi entrance duct 24 contains a series of spray nozzles (not shown) facing inwardly of the duct which emit scrubbing water covering the entire cross section of the venturi. At the middle of the scrubber is a reduced diameter cylindrical portion 25 through which the gas and particles therein are accelerated. Due to a lower pressure at the discharge side of the scrubber, caused by the suction of an exhauster or blower 33, the mixture is accelerated through the narrow orifice 25. Scrubbing water is introduced into the stream prior to passing through the orifice. The accelerating gas and particle stream shears the water stream into very small droplets or mist. Due to differential velocities between water droplets and particles and intensive turbulence, the particles are wetted by the water, agglomerate, and are consequently separated from the gases when the stream is subjected to changes in direction in the discharge section of the scrubber.

In the cyclonic separator or mist eleiminator 30, any particulate matter remaining in the gas is removed by means of centrifugal action and also deposited in slurry tank 31.

The cleaned and cooled gas is drawn from the top of the separator 30 through a gas line 32 into the inlet of an exhaust fan, indicated generally at 33. Rotation of the impeller of fan 33 creates a vacuum at its inlet. This vacuum pulls the gases through the quenchers 21, venturi scrubber 23, and cyclonic separator 30, assures that gases in the furnace stack 11 do not escape to the atmosphere, and normally pulls small controlled amounts of environmental air through the charge materials in hopper 14 into the stack 11 of the cupola 10. The fan 33, also supplies a positive pressure at its discharge end. This positive pressure is then utilized to force gases through the combustion chamber and heat exchanger of the recuperative system. The fan 33 is driven by an electric motor **33*a*. From the exhaust of the fan 33 the cleaned and cooled waste gas travels up riser duct 35 into the clean gas main 36. A bleed stack 40 and a bleed valve 41 are connected to the clean gas main and serve to bleed off excess gas not required for burning in the recuperator 43. The bleed stack 40** may vent directly to atmosphere where permitted. However, it will usually combine with other gas lines for heating purposes elsewhere in the plant.

Figure 4:
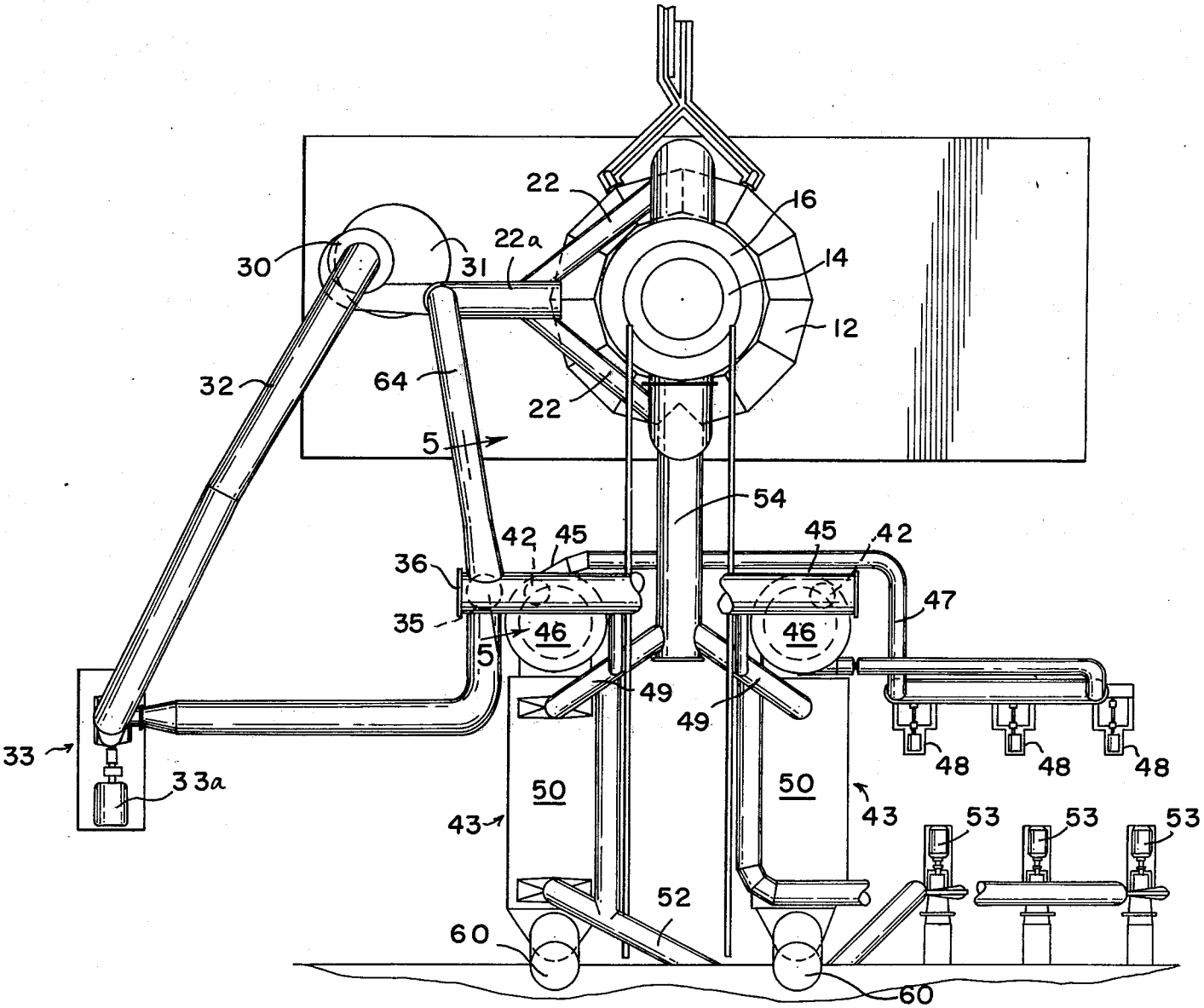
FIG. 4 is a horizontal plan view of the cupola and the entire waste gas recuperative system of FIG. 1 including the incoming blast air apparatus.

From the main 36, the cleaned and cooled gas passes through downcomer 42, across control valves **42*a*, 42*b*, and into the recuperator-heat exchanger, shown generally 43 in FIGS. 1 and 4. Valves 42*a*, 42*b*, control the amount of gases passing into the combustion chamber. Valve 42*a* controls the temperature of the blast air exiting the recuperator 43. Valve 42*b* closes the flow of waste gases to the recuperator in the event an unsafe condition exists. In FIG. 4 the complete apparatus is shown including two recuperators 43—43 in parallel whereas in the diagram of FIG. 1 only one recuperator is shown to simplify the explanation of operation. Redundant recuperators allow furnace operation while one recuperator is being repaired. The first portion of each recuperator-heat exchanger 43 is the combustion chamber shown at 44. Each combustion chamber 44 has an inlet 45 to feed oxygen carrying air into the chamber and a pilot burner section 46 which may be fueled by a commercial gas or oil. Air inlet 45 is connected by duct 47 to a plurality of combustion air fans 48 which control the amount of air fed into the combustion chamber. Typically, one of the three combustion air fans 48** shown in FIG. 4 is for stand-by use only.

The cleaned and cooled waste gases then enter the combustion chamber 44, are burned, and raised to a high temperature. The combustion or flue gases then pass into heat exchanger 50 and over heat exchanger tubes 51, which contain counterflow moving fresh blast air brought in through the intake duct 52 by air compressors 53. One of the three air compressors 53 is generally for emergency use only.

The heat from combustion waste gases is transferred to the blast air in heat exchanger 50 preheating it to a desirable temperature. From tubes 51 inside each heat exchanger 50, the preheated blast air flows through ducts 49 into the blast air main 54 and thence to the bustle pipe 12, through tuyeres 13, and into cupola furnace 10. A blast air bleed vent 55 together with bleed valve 56*a* and blast shutoff valve 56 provide for temporary or emergency shut-off of blast air to the cupola.

The waste gases having been partially burned in the furnace 10, cleaned, cooled, and completely burned a second time in combustion chamber 44 have chemically become safe for exhausting into the atmosphere through stack 60, i.e., they contain a dust loading of less than 0.05 grains/cu.ft.

The apparatus of applicant's invention includes a recirculation duct system, shown generally at 61 interconnected or extending between the positive pressure side of gas moving fan 33, at the clean gas main 36, back to a portion of the gas cleaning system, the inlet 24 of the venturi scrubber 23. More specifically, the recirculation ducting means 61 includes a primary recirculation duct 62, shown most clearly in FIGS. 5 and 6, having a primary valve control means 63 positioned therein for determining the flow through the duct, and an emergency secondary recirculation duct 64 including a secondary recirculation control valve 65 for controlling the waste gas flow through the duct.

The recirculation duct means 61 connects two portions of the waste gas recuperative apparatus on either side of fan 33, thereby creating a semi-closed circulatory path of waste gas ducting which is capable of operating independently of the cupola furnace 10, i.e., the blower 33, may remain running without harming the system after the cupola 10 has shut down. The independent ducting circulatory path created by recirculation ducting means 61 is capable of temporarily storing cleaned waste cupola gases when the cupola 10 is out of operation.

Also, an increased flow of clean waste gases through recirculation duct means 61 decreases the negative pressure differential between the cupola 10 and the recuperative waste gas system 17 thereby performing the same function as the prior art valve means which physically closed off the cupola 10 from the recuperative system 17. The uninterrupted joinder of the cupola 10 to the recuperative system 17 allows the totality of the furnace and accouterment to function together in a much more efficient manner.

The recirculation duct means 61 is also capable of maintaining the pressure drop across the venturi scrubber 23 at a desirable level whether the cupola furnace 10 is in or out of operation. The efficiency of a venturi scrubber is directly related to the pressure drop across the scrubber which determines the maximum speed the gases and particles therein attain accelerating across the venturi. In heretofore known waste gas recuperative apparatus, when the cupola furnace has been deactivated, the venturi scrubber pressure differential has dropped to zero because the air moving means, i.e., the fans, were also deactivated. In starting up a cupola and recuperative apparatus, waste gases were passed across the venturi scrubber until an adequate pressure differential was built up therein for efficient particle separation. Therefore, substantial amounts of waste gases were not sufficiently cleaned until an adequate pressure differential was reached.

Figure 7:
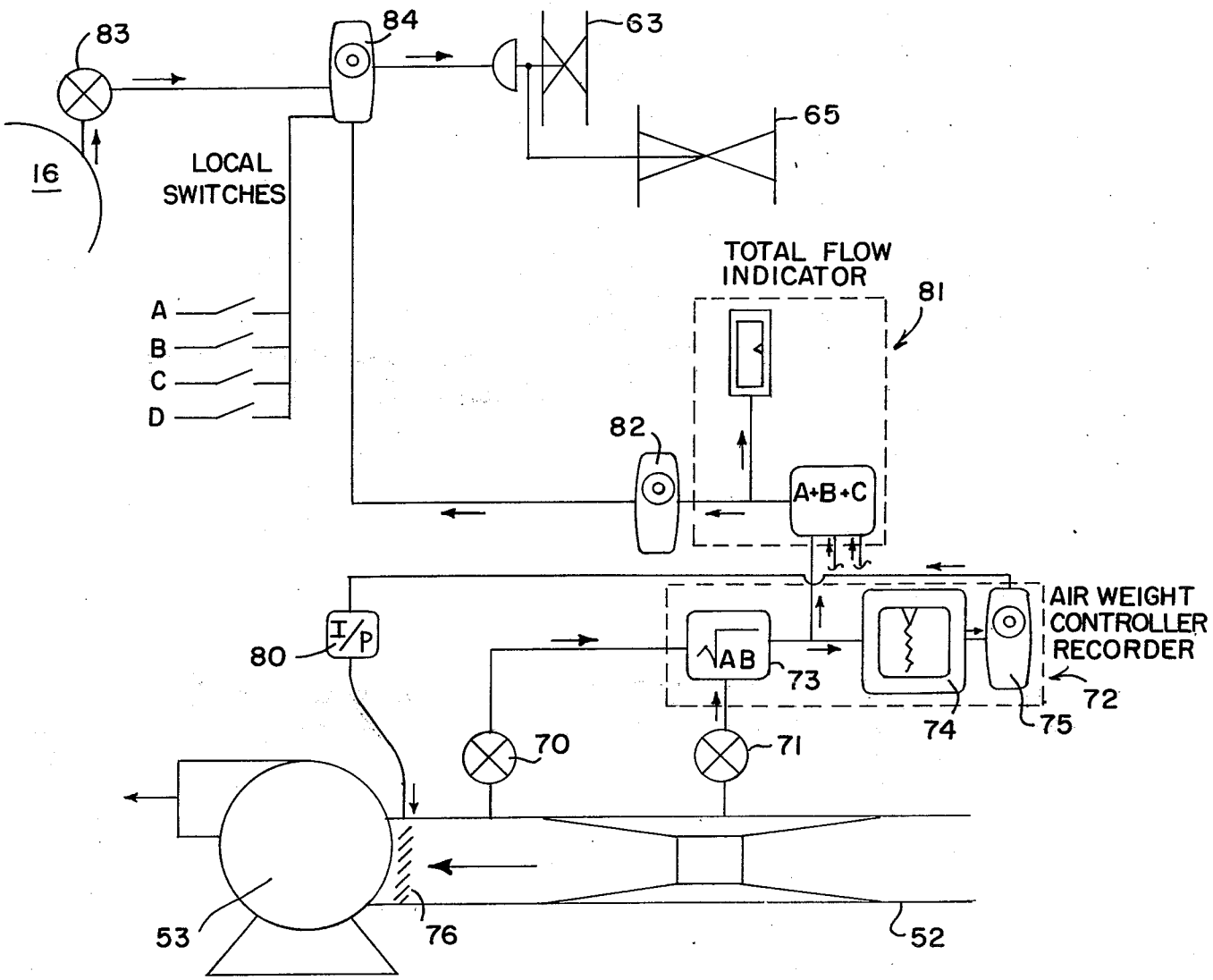
FIG. 7 is a schematic diagram of the control system which integrates the operation of the cleaning system and recuperator with the cupola furnace.

The control apparatus which integrates the safe operation of the cupola furnace and the gas cleaner and recuperator is shown schematically in FIG. 7. In order to monitor the physical conditions in the furnace-cleaner-recuperator system, sensor transmitters are positioned at various locations therein to provide input into the control apparatus. Among these are a pressure transmitter 70 and a flow transmitter 71 positioned at the intake duct 52 to each blast air compressor 53. Signals from the transmitters are sent into an air weight controller-recorder, generally at 72, which includes means for linearizing the transmitter signals at 73. The linearized signal for each compresor is then documented on recorder 74 and passed into flow controller 75. Controller 75 determines the air flow through compressor 53 by means of operating a plurality of guide vanes or a butterfly valve, symbolized at 76, at the compressor inlet through a current to pressure converter at 80. The linearized signals from each air weight controller-recorder are also added together and recorded by a total flow indicator, generally at 81. The total air flow signal is then fed into the master pressure controller 82 whose function is discussed below.

Another sensor, a differential pressure transmitter 83, is located at the cupola furnace gas take-off chamber 16. Transmitter 83 sends a signal representing the difference between atmospheric pressure and the gas take-off chamber pressure to the differential pressure controller 84. The pressure differential from transmitter 83 monitors the pressure in the gas take-off chamber 16. The differential pressure controller sends a signal which operates the primary and secondary recirculation valves 63, 65 respectively. The master pressure controller 82 adjusts the set point of the differential pressure controller 84 allowing it to correctly control the recirculation valves 63, 65 for any rate of blast air flow through the cupola furnace 10. Also, if one of the local override switches at A, B, C, D, etc. close, the set point of the differential pressure controller 84 is nulled thereby opening recirculation valves 63 and 65 to decrease the vacuum in the charge hopper 14 to zero. The local override switches are connected to various detectors located throughout the furnace and recuperative system which are discussed below.

Figure 6:
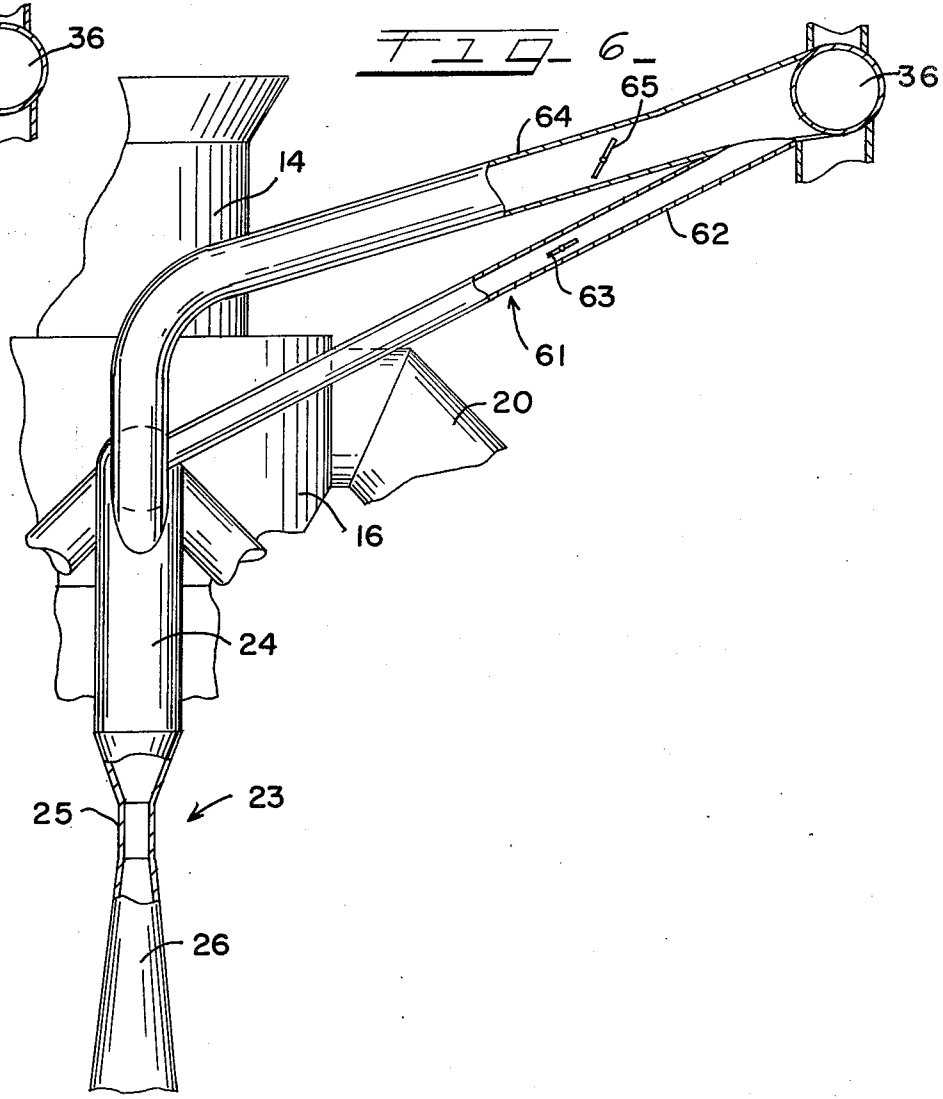
FIG. 6 is a view corresponding to FIG. 5 wherein the emergency duct valve means is open as in operation at cupola shutdown.
Figure 5:
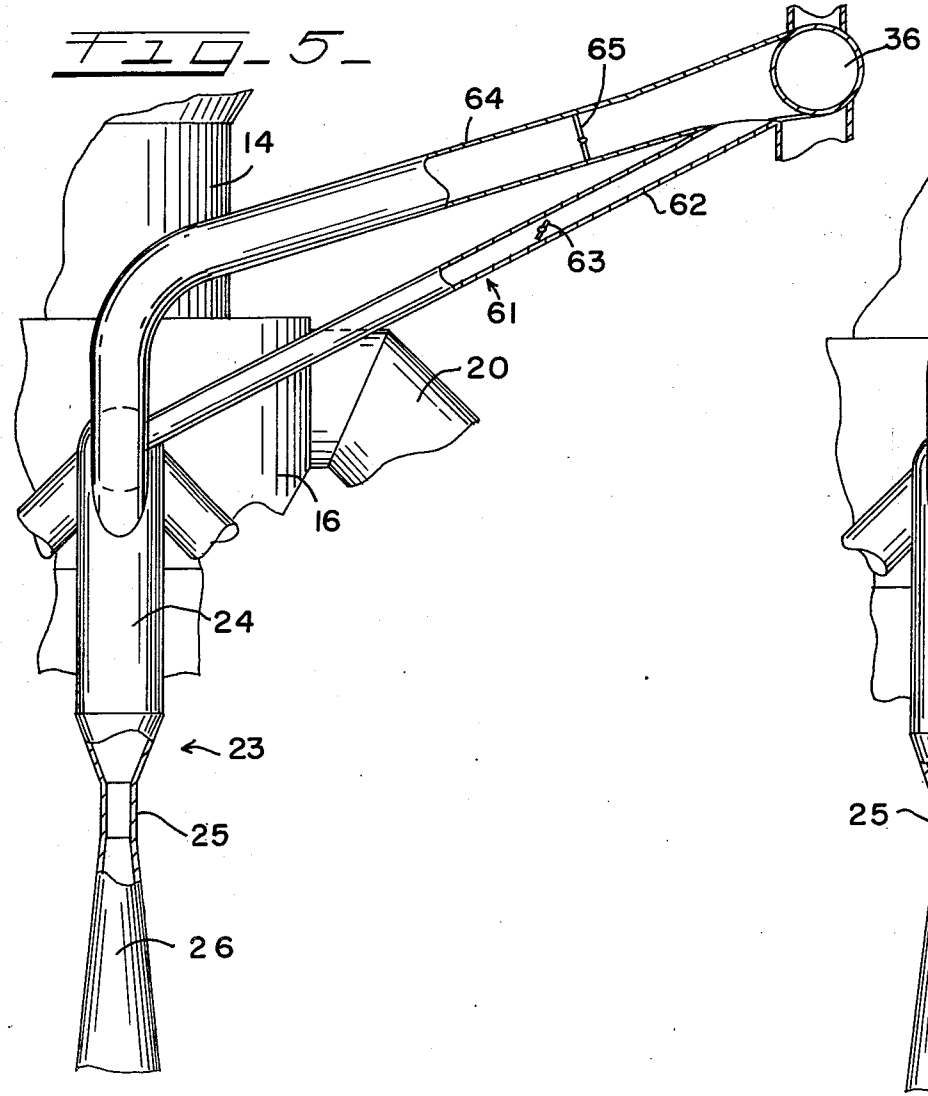
FIG. 5 is an enlarged fragmentary vertical elevational view taken on line 5—5 of FIG. 4 of the recirculation means of the invention wherein the primary duct valve means is open and the emergency duct valve means is closed as in normal operation.

In operation, the secondary recirculation valve 65, which may be a butterfly valve or other known type, in secondary recirculation duct 64 is normally closed as in FIG. 5. The primary recirculation valve 63, similarly a butterfly or other known type valve, is normally partially open allowing an approximately 10 percent recirculation of cupola waste gases. The operation of recirculation valves 63, 65 may be influenced by several means. Primarily, the amount that valves 63, 65 are opened is inversely related to the negative pressure near the top of cupola furnace 10. In other words, as the cupola is phased out of operation, the amount of blast air is substantially reduced and negative pressure increases at the top of stack 11. When this occurs, primary recirculation valve 63 opens allowing the vacuum at the top of throat 11 to decrease. If the change is drastic, secondary recirculation valve 65 in larger duct 64 is opened as shown in FIG. 6 to substantially decrease the vacuum at the top of throat 11. Primary valve 63 may operate between closed and open positions in a low range of vacuum. Secondary valve 65 operates at a high vacuum range, the lower end of which overlaps the top of the operating range for valve 63. Therefore, valve 65 begins opening shortly before valve 63 is fully open thereby avoiding flat spots during changes in the recirculation flow. This action prevents the possibility of an explosion at the top of the furnace 10 or in the gas take-off chamber 16 which would be caused by drawing in too much oxygen laden air through the interface of the top cover 15 and baffle 14 with a high vacuum in the top of the furnace. The air would combustively combine with the waste gases which are at approximately 500° F. and normally contain 18–20 percent carbon monoxide. A gas analyser (not shown) is positioned in the system to read the CO, H, and $O_2$ levels in the gas. High hydrogen content may mean a tuyere water jacket has ruptured, a potentially explosive situation.

Also, the extent recirculation valves 63 and 65 are open is conjointly dependent upon the amount of blast air flowing into the furnace. The recuperation system proportionalizes the vacuum in hopper 14 with the blast air flowing into the stack 11 for the entire range of blast air flow rates.

Control of the recirculation valves is further influenced by the level of charge in hopper 14. Conventionally, radio-active sensors 70*a*–71*a* are located at two different levels across the furnace baffle 14. When the charge therein reaches the lower level 71*a*, an indication is given to close top cover 15 and thereby prevent excess oxygen from being drawn into the take-off chamber. As the furnace is temporarily deactivated, the recirculation valves are opened as mentioned previously. Then the cover may be reopened and the furnace is recharged to upper level 70*a* adding iron making matter by charging means 18 which may be a conveyor belt, hopper, skip hoist, or the like.

It will be understood that modifications and variations may be effected without departing from the scope of the novel concepts of the present invention, but it is understood that this application is limited only by the scope of the appended claims.

I claim:

1. In a cupola furnace, a waste gas recuperative system including in combination; ducting means for passage of waste gases therethrough leading from said furnace, water spray means in said ducting for cooling said waste gases and adding mass to pollutant particles therein by wetting them to facilitate their separation, means in said ducting for separating said wetted particles from said waste gases, means for moving said waste gases through said ducting, a recuperator having a combustion chamber for combusting said waste gases, and a heat exchanger for transferring the heat of combustion of said waste gases to blast air which is thereafter fed into said cupola furnace, the improvement comprising; recirculation ducting means for diverting waste gases before they reach the combustion chamber and for returning same to the ducting means at a location upflow of said separating means, said recirculation ducting means includes a primary duct having a valve means therein which is normally at least partially open during operation, and a secondary duct for intermittent use having a diameter greater than that of said primary duct including a valve means therein which is normally closed when said furnace is in operation.

2. The waste gas recuperative system of claim 1 further including control means for opening and closing at least said primary and secondary ducting valve means in order to proportionalize a vacuum at the top of the furnace with the flow of blast air to the furnace and thereby control the amount of air indrafted into the top of the furnace.

3. In an open top cupola installation comprising an open top cupola with waste gas collecting and cleaning means and a waste gas latent heat recuperative system, said cupola having, means for introducing a variable flow of blast air into the lower portion thereof, waste gas collecting means at the top portion thereof and below the top opening therein, means for sensing and controlling the flow of said blast air, means for sensing and controlling the pressure of waste gas flowing through said waste gas collecting means; cleaning means operatively connected downstream from said collecting means including wet type dust particle removing means, exhaust fan means operatively connected downstream from said cleaning means, waste gas combustion means downstream from said exhaust fan means, and heat exchange means downstream from said combustion means operatively connected in heat exchange relation with the incoming blast air, the improvement comprising having the optimum subatmospheric pressure in said collecting means determined by said flow sensing and controlling means with said pressure sensing and controlling means being operatively responsive thereto, having as the means for controlling the inflow of ambient air into the open top of said cupola as a substantially fixed proportion of the incoming blast air and consequently as a substantially fixed proportion of the waste gas flow, a recirculating duct means including valving means therein connecting the downstream side of said exhaust fan means with the entry portion of said waste gas cleaning means, and said valving means being operatively responsive to said pressure sensing and controlling means for preventing explosions inside said waste gas collecting and waste gas cleaning means.

4. The open top cupola installation called for in claim 3 wherein said cleaning means includes a venturi scrubber having a fixed size orifice therein, and the operation of said recirculation ducting and said valving means responding to the means for sensing the pressure of said waste gas in said collecting means to provide a substantially constant flow across said fixed size orifice for efficiently removing particles from said waste gas for any flow rate of blast air into said cupola.

5. In a method of operating an open top cupola installation including an open top cupola, a wet-type waste gas cleaning system and a latent heat waste gas recuperative system, said method including the steps of: introducing a variable flow of blast air into the lower portion of said cupola; drawing gas into said cleaning and recuperative systems through a waste gas collecting means at the top portion of said cupola and below the top opening therein; measuring the flow of said blast air, measuring the pressure of waste gas flowing inside said gas collecting means; cleaning said waste gas in said cleaning system; raising the pressure of said clean waste gas in exhaust fan means to a level sufficiently high to cause flow of said clean waste gas into a combustor downstream from said exhaust fan means; burning said clean waste gas in said combustor; and exchanging heat from said burned waste gas to said incoming blast air downstream from said combustor, the improvement comprising proportionalizing the flow of incoming blast air with the flow of indrawn ambient air through the open top of said cupola by recirculating at least a portion of the flow of said clean waste gas from a point downstream of the exhaust fan means to the inlet portion of said gas cleaning system, and regulating the recirculating flow by determining the optimum subatmospheric pressure in said gas collecting means according to the flow of incoming blast air, and operating valving means to control said recirculation in response to the pressure in said waste gas collecting means for maintaining a substantially fixed proportion of air in the waste gas regardless of the flow of said incoming blast air and preventing explosions in said waste gas collecting and cleaning means.

6. The method called for in claim 5 wherein the step of operating said valving means further comprises; combining said recirculating flow with said drawn waste gas flow to provide a substantially fixed flow of gas into said gas cleaning system; and the step of cleaning said waste gas in said cleaning system further comprises; passing said fixed flow of gas through a venturi scrubber including a fixed size orifice therein for efficiently removing particles from said waste gas for any flow rate of blast air into said cupola.

* * * * *